US005716468A

United States Patent [19]

Tanaka et al.

[11] Patent Number: 5,716,468

[45] Date of Patent: Feb. 10, 1998

[54] PROCESS FOR PRODUCING HIGH-AND LOW-PRESSURE INTEGRAL-TYPE TURBINE ROTOR

[75] Inventors: Yasuhiko Tanaka; Yasumi Ikeda; Tsukasa Azuma, all of Muroran; Masayuki Yamada; Yoichi Tsuda, both of Yokohama, all of Japan

[73] Assignees: The Japan Steel Works, Ltd., Tokyo; Kabushiki Kaisha Toshiba, Kanagawa, both of Japan

[21] Appl. No.: 576,460

[22] Filed: Dec. 21, 1995

[30] Foreign Application Priority Data

Dec. 26, 1994 [JP] Japan ..... 6-336697

[51] Int. Cl.[6] ..... C21D 8/00

[52] U.S. Cl. ..... 148/649; 148/653; 148/654

[58] Field of Search ..... 148/649, 653, 148/654

[56] References Cited

U.S. PATENT DOCUMENTS

| | | | |
|---|---|---|---|
| 5,108,699 | 4/1992 | Bodnar et al. | 420/109 |
| 5,360,318 | 11/1994 | Siga et al. | 415/216.1 |

FOREIGN PATENT DOCUMENTS

| | | |
|---|---|---|
| A-0 384 181 | 8/1990 | European Pat. Off. . |
| A-53-128522 | 11/1978 | Japan . |
| B2-54-19370 | 7/1979 | Japan . |
| A-56-44722 | 4/1981 | Japan . |
| B2-62-60447 | 12/1987 | Japan . |
| 63-50419 | 3/1988 | Japan . |
| 63-69919 | 3/1988 | Japan . |
| A-63-157839 | 6/1988 | Japan . |
| 01-230723 | 9/1989 | Japan . |
| A-3-130502 | 6/1991 | Japan . |
| 5-195068 | 8/1993 | Japan . |
| A-6-41678 | 2/1994 | Japan . |
| 6-256893 | 9/1994 | Japan . |
| A-998 541 | 2/1983 | U.S.S.R. . |
| WO 90/04659 | 5/1990 | WIPO . |

*Primary Examiner*—Sikyin Ip
*Attorney, Agent, or Firm*—Oliff & Berridge

[57] ABSTRACT

A rotor forging composed of Cr—Mo—V type alloy based on iron is normalizing-treated at a temperature of from 1000 to 1150° C., the temperature is maintained at 650°–750° C. on the way of cooling the temperature from the normalizing-treating temperature to pearlite transform the microstructure of the rotor forging, the portions of the rotor forging corresponding to a high pressure or middle pressure portion are quenched at 940°–1020° C. and the portion corresponding to the low pressure portion is quenched at 850°–940° C. after the heat treatment is carried out at 920°–950° C. once or more times, and the rotor forging is subjected to tempering at 550°–700° C. once or more times. A high creep strength at the high and middle pressure portions can be obtained and, at the same time, the toughness at the low pressure portion is drastically enhanced.

3 Claims, 1 Drawing Sheet

PROCESS FOR PRODUCING HIGH-AND LOW-PRESSURE INTEGRAL-TYPE TURBINE ROTOR

FIELD OF THE INVENTION

This invention relates to a process for producing a high- and low-pressure integral-type turbine rotor used for a shaft for turbine rotor of the generator, etc.

BACKGROUND OF THE INVENTION

As one of turbine rotors, a high- and low-pressure integral-type turbine rotor in which the portions from a high pressure portion to a low pressure portion are unified has been known. The high- and low-pressure integral-type turbine rotor is exposed to pressurized steam at a high temperature and at from a high pressure to a low pressure and, thus, is required to have excellent high temperature creep strength and low temperature toughness so that it can withstand such severe operating environments.

Conventionally, as the material for the high- and low pressure integral-type turbine rotor, Cr—Mo—V type low alloy steel has been developed in this viewpoint, and furthermore, JP-B-54-19370 (the term "JP-B" used herein means "an examined Japanese patent publication"), JP-A-63-157839 (the term "JP-A" used herein means "an unexamined published Japanese patent application"), and JP-A-3-130502 disclose low alloy steels in which such a material is improved.

In producing the high- and low-pressure integral-type turbine rotor, the above alloy steel is cast and forged into a prescribed rotor's shape, subjected to a normalizing heat treatment and a solution heat treatment by heating at 900° C. or more, quenched and then tempered once or more times. It has also been suggested that by varying the solution heat treating temperatures at high and middle pressure portions and at a low pressure portion, each of pressure portions is adjusted to microstructure suitable for an operating environment (JP-B-62-60447, etc.).

As described above, in producing the turbine rotor, the section of the composition and change in the temperature for solution heat treatment per each pressure portion, and other means so as to improve the high temperature creep strength and low temperature toughness have conventionally been done, and they obtain results in some degrees. However, the requirements for the high- and low pressure integral-type turbine rotor in order to improve the efficiency for the generator, etc. have been strictly restricted. Above all, more improvement in the toughness has been strongly desired. It has been well-known for the improvement in toughness that the refining of austenitic grain size is effective, and in the material in the conventional case, the method for refining the crystal grains by selecting the composition has conventionally been used. However, it is difficult for more improvement in the toughness to only select the composition.

The present invention has been made in light of the above situations and is to provide a process for producing a high- and low-pressure integral-type turbine rotor which can refine the austenitic grain size by the device of the production stages thereby improving the low temperature toughness.

SUMMARY OF THE INVENTION

The process of the present invention in order to solve the above object comprises normalizing treating a rotor forging composed of Cr—Mo—V type alloy based on iron at a temperature of from 1000° to 1150° C., maintaining the temperature at 650°–730° C. on the way of cooling the temperature from the normalizing treating temperature to pearlite-transform the microstructure of the rotor forging into pearlite, quenching the portions of the rotor forging corresponding to a high pressure or middle pressure portions at 940°–1020° C. and the portion corresponding to the low pressure portion at 850°–940° C. after the normalizing treatment is carried out at 920°–950° C. one or more times, and subjecting the rotor forging to tempering at 550°–700° C. one or more times.

The second aspect of the present invention is the process of the first invention, wherein the composition of the rotor forging comprises 0.1 to 0.35% of C, 0.3% or less of Si, 1% or less of Mn, 1 to 2% of Ni, 1.5 to 3% of Cr, 0.9 to 1.3% of Mo, 0.1 to 0.35% of V, 0.01 to 0.15% of Nb, 0.1 to 1.5% of W, and the remainder of Fe and unavoidable impurities, all based on percentage by weight.

The third aspect of the present invention is the process of the second aspect of the present invention, wherein 0.005% or less of P, 0.005% or less of S, 0.008% or less of As, 0.004% or less of Sb, and 0.008% or less of Sn based on weight are admitted contents of the unavoidable impurities, all based on percentage by weight.

DETAILED DESCRIPTION OF THE INVENTION

Figure 1:
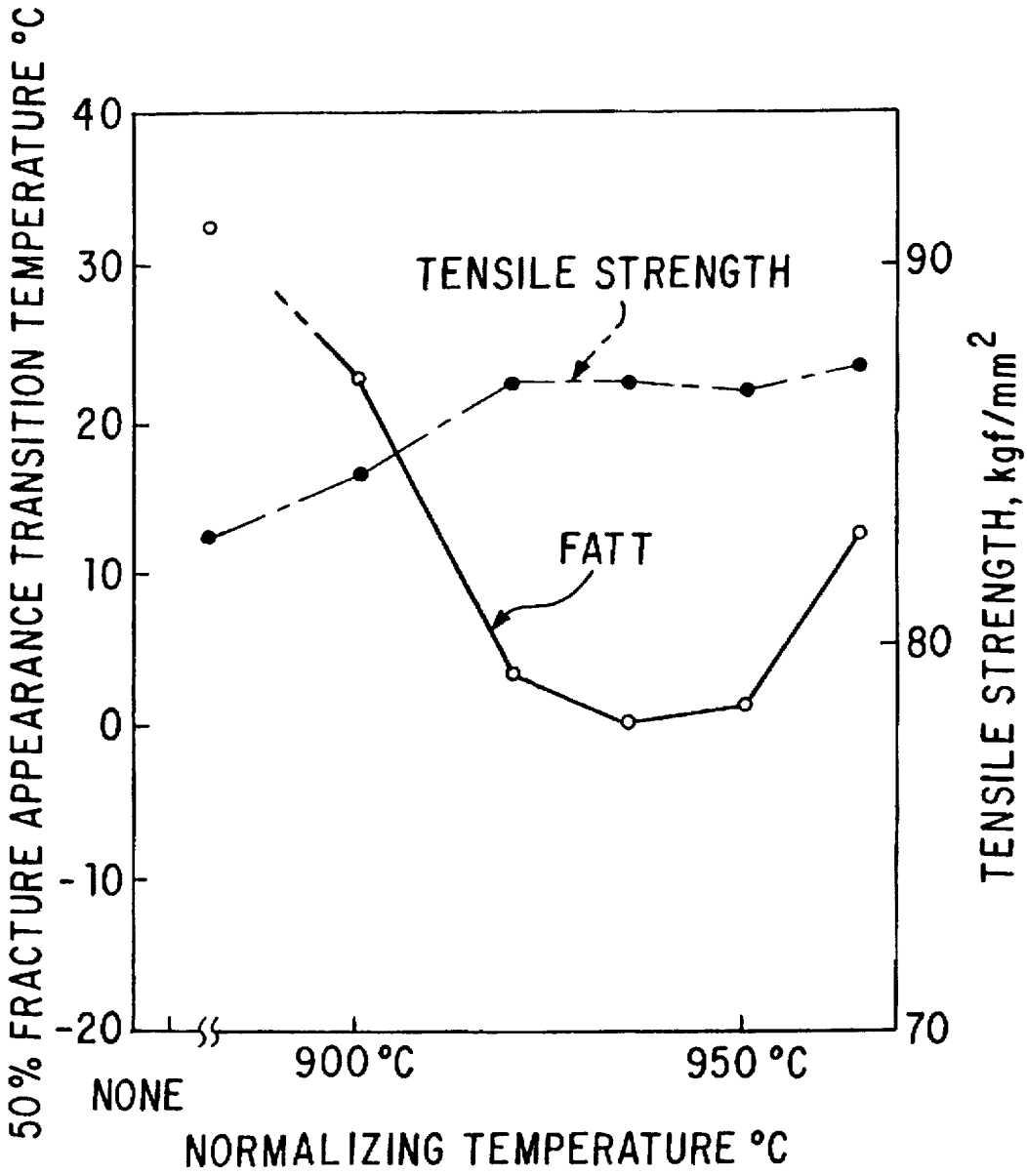
FIG. 1 shows the results of the measurement of 50% FATT and tensile strength of 2 mmV notch Charpy impact test for a rotor forging, which were measured after the heat treatment varying the normalizing temperature.

That is, according to the present invention, after the normalizing treatment, by maintaining the temperature at a prescribed temperature on the way of the cooling, the transformation of the pearlite proceeds. For this reason, the crystal grains are drastically refined at the time of heating for the austenitizing thereafter. Furthermore, by normalizing heat-treatment stage after the stage for the pearlite transformation, the crystal grains are refined at the portion corresponding to the low pressure portion which is quenched at 850°–940° C., an optimum microstructure in which the crystal grains are refined and the fine carbides are uniformly precipitated and dispersed is obtained, thereby drastically enhancing the toughness.

The treating conditions will now be described.

Normalizing Heat-Treatment

After the forging, the rotor forging is normalizing heat-treated at 1000° to 1150° C., preferably 1050° to 1100° C., to remove the adverse influences due to the forging. If the temperature is less than 1000° C., the effect cannot be obtained, and conversely, if it exceeds 1150° C., the crystal grains become coarse. For this reason, the temperature is set at this range.

Pearlite-Treatment

During the cooling from the normalizing treatment temperature, the temperature is maintained at 650°–730° C. to transform the microstructure into pearlite, whereby the crystal grains during the later transformation into austenite are drastically refined. Since the temperature range which can be pearlite-transformed is from 650° to 730° C., i.e., no pearlite transformation proceeds even if the temperature is maintained at less than 650° C. or more than 730° C., the temperature is restricted to the above temperature range.

Normalizing-Treatment

After the rotor forging is pearlite-treated, it is further subjected to a normalizing-treatment at a temperature of 920°–950° C., preferably 920°–935° C. one or more times whereby an optimum microstructure having fine grains can be obtained at the portion corresponding to a low pressure portion at the quenching stage which is a post-treatment. If the normalizing heat-treatment is not carried out or is carried out at a temperature lower than 920° C., all of the carbides such as cementite which are separated in the austenite grain and coarsened cannot be dissolved and the coarse carbides remain after the normalizing treatment. Consequently, no good toughness can be obtained after the thermal refining which is a post-treatment. Since the melting of the carbides are also imperfect in this case, the softening of the material is easily brought about by the tempering after the quenching, which makes it difficult to obtain a microstructure having a high strength and a high toughness. FIG. 1 shows the results of the measurement of 50% fracture appearance transition temperature (FATT) and tensile strength of 2 mmV notch Charpy impact test measured after the heat treatment varying the normalizing temperature, the cooling simulating the portion corresponding to the central portion of a large-size HLP rotor, and then tempering is carried out under the same conditions. It has been proven that these characteristics are greatly changed depending upon the normalizing conditions, and good toughness is obtained at a temperature range of from 920° to 950° C. On the other hand, if the heating temperature is higher than 950° C., the grains are enlarged during the normalizing which have an influence upon the grain size after the thermal refining. Consequently, the normalizing is carried out in the above temperature range.

Thermally Quenching Temperature

High and Middle Pressure Portions: 940°–1020° C., preferably 945°–980° C.

Low Pressure Portion: 850°–940° C., preferably 880°–920° C.

By differing the heating temperatures at high and middle pressure portions and at a low pressure, at the portions corresponding to the high and middle pressure portions, sufficient creep strength is attained, while at the portion corresponding to the low pressure portion, low temperature toughness is attained. If the austenitizing temperature at the high and middle pressure portions is less than 940° C., no sufficient creep strength can be obtained. Conversely, if it exceeds 1020° C., the creep ductility is decreased. Consequently, the temperature is set at the above range. On the other hand, if the austenitizing temperature at the low pressure portion is less than 850° C., no optimum microstructure is obtained, and if it exceeds 940° C., the austenitic grain size is enlarged, thereby decreasing the low temperature toughness. Consequently, the temperature is set at this range.

The austenitizing temperature at the high and middle pressure portions is desirably set at a temperature 20° to 100° C. higher than that at the low pressure portion, because in order to sufficiently obtain the above functions and effects, it is required to have the 20° C. or more of the temperature difference between them, and if the temperature difference exceeds 100° C. it is difficult to be produced.

The cooling rate at the quenching is desirably different from the high and middle pressure portions and the low pressure portion. Typically, the portions corresponding to the high and middle pressure portions are quenched at a cooling rate lower than the air impact rate in order to obtain a good high temperature creep strength, because if they are cooled at a cooling rate exceeding the air impact rate, the ratio of the amount of the low temperature transformed bainite is increased and, no sufficient high temperature creep strength can be obtained. The portion corresponding to the low pressure portion is quenched at a cooling rate exceeding the oil cooling rate in order to obtain a good low temperature toughness, because if it is quenched at a cooling rate lower than the oil cooling rate, the microstructure containing a ferrite or a high temperature transformed bainite at the central portion is obtained and, thus, no good low temperature toughness can be obtained.

Tempering Temperature: 550°–700° C.

By subjecting the tempering to the rotor forging at 550°–700° C. one or more times, a desired strength can be obtained. If the tempering is carried out at temperature less than 550° C., no sufficient tempering effect can be obtained and, thus, no good toughness can be obtained. Conversely, if the tempering temperature exceeds 700° C., any desired strength cannot be obtained. Consequently, the tempering temperature is set at the above range.

The rotor forging described in the second or third aspect of the present invention is suitable for applying the above production process, and significant effects can be obtained. In these cases, a turbine rotor excellent in a tensile strength, a high temperature creep strength, and a low temperature toughness can be obtained. The reasons for restricting the compositions of these rotor forgings will now be described.

C: 0.1 to 0.35%

C stabilizes the austenite phase during the quenching, and forms carbides to enhance the tensile strength. In order to exhibit these effect, it is required to contain C in an amount of not less than 0.1%. However, if the amount exceeds 0.35%, an excess amount of carbides are formed, which decrease not only tensile strength but also toughness. Consequently, the content of C is restricted to the range of from 0.1 to 0.35%, and preferably from 0.18 to 0.3%.

Si: not more than 0.3%

Si is added at the melting as an oxygen scavenger. If it is added in a large amount, part of Si remains in the steel as an oxide thereof which has an adverse influence on the toughness. Consequently, the upper limit of the Si content is restricted to 0.3% and more preferably to 0.1%.

Mn: not more than 1%

Mn is added at the melting as an oxygen scavenger and as a desulfurization agent. Since the toughness is decreased if it is added in a large amount, the upper limit of the content is restricted to 1%, and more preferably to 0.7%.

Ni: 1 to 2%

Ni is an element for forming austenite, and is effective for stabilizing the austenite phase during the thermal quenching and for preventing the formation of a ferrite phase during the quenching and cooling. Moreover, it is effective for enhancing the tensile strength and toughness. In order to obtain the tensile strength and toughness needed as a high- and low-pressure integral-type turbine rotor, it is necessary to contain Ni in an amount of not less than 1%. However, if it is contained in an amount exceeding 2%, there are tendencies that the creep rupture strength is decreased and brittleness at a high temperature is accelerated. Consequently, the content is restricted to the range of from 1 to 2%, and more preferably from 1.3 to 1.8%.

Cr: 1.5 to 3%

Cr is an element effective for preventing oxidation, increasing the properties of quenching the steel, and enhancing the tensile strength and toughness. For these purposes, the content is required to be not less than 1.5%, but if it exceeds 3%, the toughness and tensile strength are decreased and, at the same time, shaft goring characteristics are decreased. Consequently, the content is restricted to the range of from 1.5 to 3%, and more preferably from 1.8 to 2.5%.

Mo: 0.9 to 1.3%

Mo is an element effective for enhancing the properties of quenching the steel, and enhancing the tensile strength and creep rupture strength. In order to obtain the tensile strength and creep rupture strength needed as a high- and low-pressure integral-type turbine rotor, it is necessary to contain Mo in an amount of not less than 0.9%. On the other hand, if it exceeds 1.3%, the creep rupture strength is decreased, the toughness is significantly decreased, and segregation of components at the central portion of the turbine rotor, especially the segregation of the C, is significantly confirmed. Consequently, the Mo content is restricted to the range of from 0.9 to 1.3%, and more preferably from 1.0 to 1.2%.

V: 0.1 to 0.35%

V is an element effective for enhancing the quenching properties, and creep rupture strength, and for refining the crystal grains. It is required for exhibiting these results to contain V in an amount of not less than 0.1%. However, if the content exceeds 0.35%, the toughness and tensile strength are decreased. Consequently, the content is restricted to the range of from 0.1 to 0.35%, and more preferably from 0.15 to 0.30%.

Nb: 0.01 to 0.15%

Nb is an element effective for refining the crystal grains. It is required for exhibiting such an effect to contain it in an amount of 0.01% or more. However, if it exceeds 0.15%, a coarse nitrogen carbide is formed to decrease the toughness. Consequently, the content is restricted to the range of from 0.01 to 0.15%, and more preferably from 0.02 to 0.10%.

W: 0.1 to 1.5%

W is an element effective for enhancing the high temperature strength through strengthening by solid solution. It is required for exhibiting such an effect to contain it in an amount of 0.1% or more. However, if it exceeds 1.5%, the creep rupture strength and toughness are decreased. Consequently, the content is restricted to the range of from 0.1 to 1.5%, and more preferably from 0.2 to 0.8%.

Unavoidable Impurities

When the high- and low-pressure integral-type rotor is used under a high temperature environment exceeding 500° C., fine carbides contributing to the strengthening of the alloy material are aggregated to be enlarged, and does not contribute to the reinforcement, gradually, to decrease the tensile strength and creep rupture strength. Moreover, if it is used under an environment of a temperature range of from 350° to 450° C., impurities contained in the alloy material tend to be segregated on the grain boundary, which weakens the interatomic boundary strength of the grain boundary. This causes the brittleness with the elapse of time. From these viewpoints, of the accompanying impurities, when the content of P is not more than 0.005%, that of S is not more than 0.005% (preferably not more than 0.001%), that of As is not more than 0.008%, that of Sb is not more than 0.004%, and that of Sn is not more than 0.008%, the amount of grain boundary segregation can be drastically decreased and, at the same time, the decrease in the strength and decrease in the toughness during operation with elapse of time can be greatly suppressed. As a result, long-term stability of the high- and low pressure integral-type rotor can be secured to enhance the life thereof and, at the same time, dangerous for brittle fracture can be prevented, making it possible to run the rotor over a prolong period of time.

EXAMPLE

The steel to be tested having the composition as shown in Table 1 was melted in a vacuum melting furnace to produce 50 kg of ingot. The ingot was heated at 1200° C., forged at a forging ratio of approximately 4 to produce a turbine rotor forging, and subjected to the heat treatments shown in Table 2.

In the quenching, the cooling was carried out at a cooling rate of 50° C./h assuming the cooling rate at the central portion of the low pressure portion in spray cooling. Moreover, after the quenching, each element was subjected to tempering at 640°–660° C. for 20 hours.

Subsequently, the steels to be tested after the heat treatments were tested for material test. The results are shown in Table 3. As is clear from Table 3, according to the present invention, the toughness of the material assuming the central portion at the low pressure portion was enhanced without impairing the creep strength of the material assuming the high pressure portion in comparison with the product obtained by the conventional process.

TABLE 1

| | (% by weight) |
|---|---|
| Essential Components | |
| C | 0.24 |
| Si | 0.02 |
| Mn | 0.45 |
| Ni | 1.69 |
| Cr | 2.22 |
| Mo | 1.08 |
| V | 0.19 |
| Nb | 0.015 |
| W | 0.19 |
| Unavoidable Impurities | |
| P | 0.003 |
| S | 0.0008 |
| As | 0.004 |
| Sb | 0.001 |
| Sn | 0.004 |

TABLE 2

| | Treating conditions before thermal refining | | | Heat treating conditions at thermal refining | | | |
|---|---|---|---|---|---|---|---|
| | | | | Central portion of low pressure portion | | Central portion of high pressure portion | |
| Test No. | Normalizing | Pearlite-transformation | Normalizing | Quenching | Tempering | Quenching | Tempering |
| Present Invention | | | | | | | |
| 1 | 1100° C. × 3 h | 680° C. × 300 h | 950° C. × 3 h | 900° C. × 3 h | 640° C. × 20 h | 960° C. × 3 h | 660° C. × 20 h |
| 2 | " | " | " | 880° C. × 3 h | " | 940° C. × 3 h | " |
| 3 | " | " | " | 940° C. × 3 h | 660° C. × 20 h | " | 670° C. × 20 h |
| 4 | " | " | 930° C. × 3 h | 900° C. × 3 h | 640° C. × 20 h | 950° C. × 3 h | 660° C. × 20 h |
| 5 | " | " | " | 880° C. × 3 h | " | " | " |
| 6 | " | " | " | 930° C. × 3 h | 660° C. × 20 h | 970° C. × 3 h | 670° C. × 20 h |
| 7 | 1050° C. × 3 h | 700° C. × 300 h | 950° C. × 3 h | 900° C. × 3 h | 640° C. × 20 h | 960° C. × 3 h | 660° C. × 20 h |
| 8 | " | " | 930° C. × 3 h | " | " | 950° C. × 3 h | " |
| Comparative | | | | | | | |
| 9 | 1100° C. × 3 h | 680° C. × 300 h | 900° C. × 3 h | " | " | " | " |
| 10 | " | " | 980° C. × 3 h | " | " | 970° C. × 3 h | " |
| 11 | " | " | None | 880° C. × 3 h | " | " | " |
| 12 | " | " | None | 900° C. × 3 h | " | 950° C. × 3 h | " |
| 13 | " | None | None | 930° C. × 3 h | " | 970° C. × 3 h | " |

TABLE 3

| | Central Portion of Low Pressure Portion (Strength, Toughness) | | | Central Portion of High pressure portion (Creep strength*) | |
|---|---|---|---|---|---|
| Test No. | Tensile Strength Kgf/mm² | FATT °C. | $vE_{20}$ kgf-m | Rupture Time h | Elongation after Rupture % |
| Present Invention | | | | | |
| 1 | 86.8 | +3 | 14.0 | 253 | 24.2 |
| 2 | 86.1 | −8 | 19.6 | 204 | 20.4 |
| 3 | 77.4 | −31 | 22.6 | 188 | 23.8 |
| 4 | 86.9 | 0 | 14.5 | 233 | 26.3 |
| 5 | 84.8 | −14 | 16.0 | 240 | 23.0 |
| 6 | 78.6 | −36 | 20.5 | 229 | 25.0 |
| 7 | 87.1 | +7 | 15.2 | 263 | 25.8 |
| 8 | 86.6 | +1 | 17.9 | 246 | 26.7 |
| Comparative | | | | | |
| 9 | 83.2 | +37 | 3.3 | 190 | 28.7 |
| 10 | 88.0 | +42 | 4.6 | 262 | 24.0 |
| 11 | 83.8 | +25 | 6.5 | 247 | 24.7 |
| 12 | 85.4 | +61 | 1.9 | 208 | 21.3 |
| 13 | 90.7 | +52 | 5.1 | 239 | 23.0 |

*Conditions for measuring creep strength: 550° C. × 30 kgf/mm²

As described above, according to the process for producing a high-and low-pressure integral-type turbine rotor of the present invention, a rotor forging composed of Cr—Mo—V type alloy based on iron is normalizing-treated at a temperature of from 1000° to 1150° C. the temperature is maintained at 650°–750° C. on the way of cooling the temperature from the normalizing treating temperature to pearlite-transform the microstructure of the rotor forging, the portions of the rotor forging corresponding to a high pressure or middle pressure portions are quenched at 940°–1020° C. and the portion corresponding to the low pressure portion is quenched at 850°–940° C. after the normalizing-treatment is carried out at 920°–950° C. once or more times, and the rotor forging is subjected to tempering at 550°–700° C. once or more times. Accordingly, the present invention has effects that a high creep strength at the high and middle pressure portions can be obtained and, at the same time, the toughness at the low pressure portion is drastically enhanced. Furthermore, in carrying out the process, these effects can be significantly manifested when a turbine rotor forging having a prescribed composition is used. In addition, a high- and low pressure integral-type turbine rotor excellent in tensile strength and high temperature creep rupture strength can be obtained.

What is claimed is:

1. A process for producing a high- and low-pressure integral turbine rotor comprising:

normalizing-treating a rotor forging composed of a Cr—Mo—V alloy based on iron at a temperature of from 1000°–1150° C. to provide a normalized rotor forging;

cooling the normalized rotor forging to 650°–730° C. from the normalizing treating temperature to pearlite-transform the microstructure of the rotor forging;

further normalizing-treating the rotor forging at a temperature of from 920°–950° C. one or more times;

heating a high pressure or a middle pressure portion of the normalized rotor forging to 940°–1020° C. and a low pressure portion of the normalized rotor forging to 850°–940° C.;

quenching said high pressure or middle pressure portion and said low pressure portion;

and subjecting the quenched rotor forging to tempering at 550°–700° C. one or more times.

2. A process as claimed in claim 1, wherein the composition of the rotor forging comprises 0.1 to 0.35% of C, 0.3% or less of Si, 1% or less of Mn, 1 to 2% of Ni, 1.5 to 3% of Cr, 0.9 to 1.3% of Mo, 0.1 to 0.35% of V, 0.01 to 0.15% of Nb, 0.1 to 1.5% of W, and the remainder of Fe and unavoidable impurities, all based on percentage by weight.

3. A process as claimed in claim 2, wherein 0.005% or less of P, 0.005% or less of S, 0.008% or less of As, 0.004% or less of Sb, and 0.008% or less of Sn are admitted contents of the unavoidable impurities, all based on percentage by weight.

* * * * *